United States Patent [19]

Imral

[11] 4,109,708

[45] Aug. 29, 1978

[54] AIR CONDITIONER UNIT HAVING COMPARTMENT PROVISIONS FOR ACCESS AND MOTOR COOLING

[75] Inventor: Sadik S. Imral, St. Louis, Mo.

[73] Assignee: Intertherm, Inc., St. Louis, Mo.

[21] Appl. No.: 762,008

[22] Filed: Jan. 24, 1977

Related U.S. Application Data

[63] Continuation of Ser. No. 606,538, Aug. 21, 1975, abandoned.

[51] Int. Cl.[2] ..... F24F 1/02

[52] U.S. Cl. ..... 165/48 R; 165/54; 165/76; 165/122

[58] Field of Search ..... 165/42, 48, 53, 58, 165/59, 76, 121, 122; 219/371–374, 366, 367; 62/DIG. RTV, 262

[56] References Cited

U.S. PATENT DOCUMENTS

| | | | |
|---|---|---|---|
| 2,401,560 | 6/1946 | Graham et al. | 165/59 |
| 3,267,255 | 8/1966 | Schulz | 219/373 |
| 3,275,069 | 9/1966 | Kelly | 219/371 |
| 3,362,469 | 1/1968 | Berner et al. | 219/371 |
| 3,665,727 | 5/1972 | Mather | 62/262 |
| 3,741,290 | 6/1973 | Nenadal | 165/48 |
| 3,833,052 | 9/1974 | Cardind | 165/122 |

*Primary Examiner*—Charles J. Myhre
*Assistant Examiner*—Theophil W. Streule, Jr.

[57] ABSTRACT

An L-shaped, vertical partition within an air conditioner housing divides off a condenser compartment which has a supplementary air inlet and an air corridor therefrom. One panel of this partition mounts, at its side within the air corridor, the motor which drives the evaporator blower. An access door, opposite to the partition panel, permits the entire assembly to be removed for servicing and to permit access to the other parts. Where the blower system is to be used alternately with a resistance heater coil, this blower motor may be equipped with its own cooling fan.

5 Claims, 3 Drawing Figures

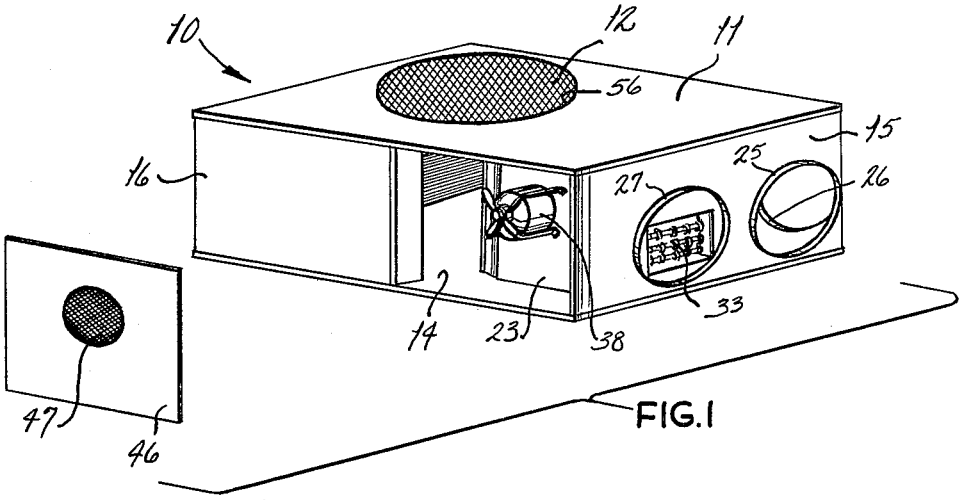
FIG. 1
FIG. 2
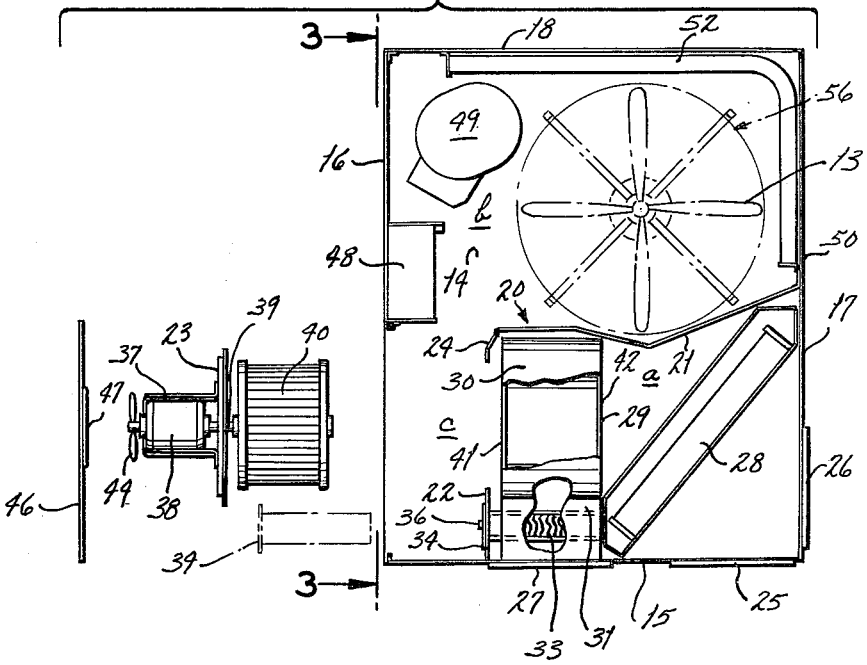
FIG. 3
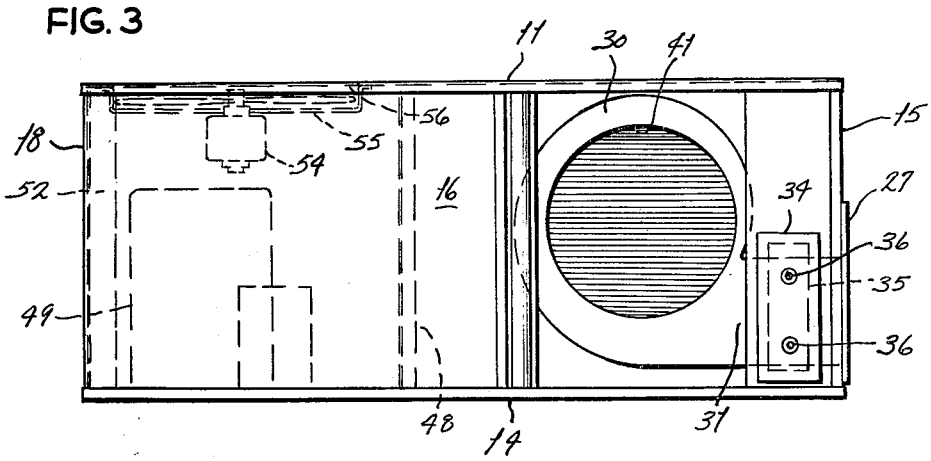

AIR CONDITIONER UNIT HAVING COMPARTMENT PROVISIONS FOR ACCESS AND MOTOR COOLING

This is a continuation, of application Ser. No. 606,538 filed Aug. 21, 1975, now abandoned.

BACKGROUND OF THE INVENTION

Many self-contained air conditioning units, in particular of the type installed at ground level partly beneath the floor of a mobile home, conventionally have an exhaust fan in the top surface of a condenser compartment, which top surface projects sideward beyond the mobile home. At the side adjacent or below the mobile home, a cooled air outlet may have a duct connection to the mobile home and a return air inlet into its evaporator compartment. Under this arrangement two separate fan motors must be used, one for the evaporator blower which blows the cooled air and one for the exhaust fan in the top of the condenser compartment. In such arrangement the evaporator blower motor is conventionally located in the evaporator compartment and is cooled by flow of air therethrough. The offsetting disadvantage is that since such motors are usually about 60% efficient, 40% of the energy of the evaporator blower motor will go off as heat which leaves the evaporator compartment along with the discharged cool air. In a typical case this location of the blower motor reduces the cooling capacity approximately 4%.

With this type of air conditioner, it is ordinarily necessary to remove much of the top wall for access to parts which may require servicing. Most frequently these are electrical components including the blower motor and a resistance heater coil such as is frequently added within the evaporator compartment. Another component within the evaporator compartment which must be accessible for servicing is the evaporator blower wheel, which may go out of balance. For access to the evaporator compartment through its top wall it may be necessary to move the entire air conditioner out from its position partly beneath the edge of the mobile home.

SUMMARY OF THE INVENTION

While reference is made to the detailed description for a full understanding of the present invention, it may be briefly summarized, without limitation, as follows:

The condenser compartment is L-shaped, to provide an air corridor portion sideward of the blower scroll which leads to the cooled air outlet. The divider which there separates the condenser compartment from the evaporator compartment has a panel removable from the condenser compartment side. Assembled onto it on the air corridor side is the motor for the evaporator blower. The shaft of that motor extends through the panel to mount the blower wheel on the opposite side. An access door, which includes an auxiliary air inlet for the air corridor, is positioned opposite the panel so that air may there enter to flow over and cool the evaporator motor, being drawn thereover through the air corridor by the exhaust fan. Removal of the access door permits direct access to the evaporator blower motor; and when it is removed along with the partition and the blower wheel, access is provided through the blower scroll to the interior of the evaporator compartment.

When an electric resistance heater is added or if the unit is to be used to circulate air without cooling, a supplementary fan is mounted on the blower motor shaft in the condenser compartment, positioned between the blower scroll and the cooled air outlet. This permits the evaporator blower to circulate heated air without operating the exhaust fan of the condenser compartment; its operation may otherwise be necessary because of the unconventional positioning of the evaporator blower motor. Such resistance heater is mounted in a slot through the divider wall, with its terminals in the air corridor portion of the condenser compartment, for easy access through the access door.

BRIEF DESCRIPTION OF THE DRAWINGS

FIG. 1 is a perspective view partly from above of an air conditioner embodying the present invention, shown with the access door removed.

FIG. 2 is a view from above of the air conditioner of FIG. 1, with its entire top wall removed. As in FIG. 1, the access door is removed; also shown exploded to the left is an assembly consisting of a panel of the partition, the evaporator blower motor and evaporator blower wheel. The phantom lines show a resistance heater coil removed to the left.

FIG. 3 is the side view seen along line 3—3 of FIG. 2.

DESCRIPTION OF THE PREFERRED EMBODIMENT

The embodiment of the invention described is the type of air conditioner which is conventionally installed at ground level, partly beneath the floor of a mobile home and partly extending sideward thereof. The air conditioner shown has a rectangular housing or cabinet 10 whose height is its smallest dimension. In its top wall 11 a circular grill 12 covers an exhaust fan 13 for the condenser compartment; in normal installation this portion will project outwardly of the mobile home.

The air conditioner components are arranged on the housing bottom wall 14. In referring to the walls of the housing, that wall which is normally placed beneath the mobile home is referred to as its inner edge wall 15; the walls adjacent to it are referred to as the left and right adjacent sidewalls 16, 17 and the wall opposite it as the outer side wall 18.

Functionally the cabinet 10 is divided, as best seen in FIG. 2, by a vertical, nearly L-shaped divider generally designated 20, including a first fixed divider portion 21 which is spaced between the inner edge wall 15 and the outer side wall 18, being bent toward the inner edge wall 15 slightly to accommodate the exhaust fan 13. The divider 20 includes also a second fixed portion 22, which extends substantially perpendicularly outward from the inner edge wall 15, and a removable panel portion 23 which is affixed between the perpendicular portion 22 and an angular juncture 24 with the first described divider portion 21.

By the portions of the divider 20 so described, the housing 10 is separated into an evaporator compartment generally designated *a*, bounded by the inner edge wall 15 and part of the adjacent wall 17 as well as by the divider portions 21, 24 and 22; and a condenser compartment *b* which is generally L-shaped and whose smaller part *c* extends to the inner edge wall 15.

The evaporator compartment *a* has a flanged circular inlet 25 in the inner edge wall 15 near its juncture with the right adjacent side wall 17, and preferably has a second similar inlet 26 in that side wall, close to the inner edge wall 15. Conventionally, flexible ducts, not shown, conduct return air from the fixed duct system of a mobile home to the inlets 25, 26; if only one such inlet is required, the other is sealed off. In the inner edge wall 15 there is also provided a circular flanged cooled air outlet 27.

The conventional air conditioner components located within the evaporator compartment *a* include an evaporator coil 28, mounted vertically and slantingly across the inlets 25, 26. Beyond it in the path of air flow is the inlet 29 of an evaporator blower scroll 30 whose outlet duct 31 leads to the cooled air outlet 27. As seen from FIG. 2, the scroll 30 is arranged perpendicular to the inner edge wall 15 and close to the fixed divider portion 22.

Installed in the scroll outlet duct 31 adjacent to the cooled air outlet 27 is an electrical resistance heater 33, presented inwardly of the cooled air outlet 27. The resistance heater 33 has a vertical mounting flange 34 securable to the left side of the fixed divider portion 22, the resistance heater 33 being inserted through a slot 35 therein, leaving its terminals 36 projecting in the condenser compartment portion *c*.

On the removable panel portion 23 of the divider 20, extending to the left of FIG. 2, is a bracket 37 mounting the evaporator blower motor 38 whose shaft 39 extends through the divider panel 23 to its right side. On this side is mounted the evaporator blower wheel 40, which fits through the left side opening 41 of the blower scroll 30; the right side opening 42 of the scroll 30 is the opening through which air is drawn. Mounting screws, not shown, mount the removable panel divider portion 23 in position shown in FIG. 1. On removal of the screws, the assembly is removable to the left as shown in FIG. 2, removing the blower wheel 40 axially from its scroll 30.

Preferably the blower motor 38 is equipped with a small supplementary motor cooling fan 44, whose function will be described hereafter.

To permit access for servicing without removing the housing top wall 11, the left adjacent side wall 16 has, opposite the panel 23, a full height access door 46 mounted by removable screws, not shown. In the door 46 is a screened auxiliary air inlet 47.

The remainder of the condenser compartment is substantially conventional. Immediately adjacent to the access door 46 is an electrical control or junction box 48. A conventional motorized refrigeration compressor 49 is positioned adjacent to it. The greater portion of the outer side wall 18, and a part of the right side wall 17 adjacent to it, are cut out to provide a main outside air inlet 50 in which a coil 52, formed to the right angular shape shown in FIG. 2, is positioned. An exhaust fan motor 54, which may be mounted on brackets 55 in a baffle opening 56 beneath the circular grill 12, powers the exhaust fan 13 whose blades are closely beneath the grill 12.

It is to be understood that the components described are supplemented by conventional air conditioning components and accessories such as valves and controls and are operatively connected to each other in the conventional manner except in the respects particularly set out herein. Likewise the resistance heater 33 is operatively connected by conventional connectors and controls.

The unusual functioning of the present invention and the reasons for the described arrangement of the components will now be explained. In the type of prior air conditioner which uses an exhaust fan in a portion of the housing top wall which is outstanding from a mobile home, the axis of the motor which powers such fan will be displaced from the axis of the evaporator blower motor; hence separate motors for these two functions are necessarily utilized. The motor for the evaporator blower scroll 30 would then normally be located in the evaporator compartment *a;* with the advantage that during cold weather when it was desired to operate a resistance heater in the evaporator air system, the motor for only the evaporator blower would have to be powered. However, such conventional arrangement carries with it the disadvantage that the heat from the evaporator blower motor is emitted into the evaporator compartment; during the cooling cycle this heat reduces the cooling capacity. In a typical case, with electric motors being only about 60% efficient, approximately 40% of the power required by the evaporator blower motor would go off as heat in the evaporator compartment, reducing the cooling capacity by roughly 4%, more or less.

By locating the evaporator blower motor 38 in the smaller portion *c* of the condenser compartment *b*, its waste heat is emitted into this compartment, which is conventionally insulated from the evaporator compartment *a*. During the cooling cycle, with the condenser compartment fan 13 providing suction, air inflowing through the auxiliary air inlet 47 is drawn through the condenser compartment portion *c*, and passes over and around the evaporator blower motor 38 to the exhaust fan 13 in the main condenser compartment *b*. Thus the smaller compartment portion *c* serves as an air corridor. However, during the heating cycle, the exhaust fan 13 need not be operated. The supplementary cooling fan 44 outstanding on the shaft of the blower motor 38 and located close to the auxiliary air inlet 47, provides it with adequate cooling.

A significant advantage of the present invention is the access provided for servicing without removing the top wall 11. Screws holding the door 46 are first removed, giving direct access to the blower motor 38, the heater 33 and its terminals 35, as well as the junction box 48. All such parts may then be readily serviced or replaced. As shown in phantom lines in FIG. 2, when the mounting flange 34 of the resistance heater 33 is unscrewed, the heater may be removed through its slot in the partition portion 22 from its position in the evaporator blower scroll outlet duct 31. Also working through the open space between the junction box 48 and the partition corner 24, there is access to the interior of the main condenser compartment *b*, and thus to the compressor 49 and the motor 54.

Further, on removing the divider panel 23, as shown in FIG. 2, the assembly (shown to the left in FIG. 2) which includes the motor 38 and evaporator blower wheel 40 may be removed. Since these elements may require replacement, constructing them as a unit is a convenience. While they are removed, the operator may reach through the left opening 41 of the blower scroll 30 for direct access to the coil of the resistance heater 33. If he desires, he may have access through the right opening 42 of the blower scroll 30, to reach as far as the evaporator coil 48.

Should no resistance heater 33 be employed in the air delivery system, the supplementary fan 44 may be omitted. Other modifications will from this disclosure suggest themselves to persons having ordinary skill in the air conditioner art.

I claim:

1. A self-contained air conditioner unit of the type having a motor for blowing cooled air separate from the motor for cooling the condenser, comprising a housing having an angled divider extending top to bottom, whereby to divide the housing into an evaporator compartment bounded on two adjacent sides by a condenser compartment, the evaporator compartment having a return air inlet, an evaporator coil, and a blower whose scroll leads to a cooled air outlet, the condenser compartment having a compressor, a main outside air inlet having a condenser coil thereadjacent, and a warm air outlet having an exhaust fan thereat mounted on the vertical shaft of a first motor, the condenser compartment further including an air corridor portion along one side of the evaporator compartment, said air condenser portion including an auxiliary air inlet spaced from the main outside air inlet, and a second motor powering said evaporator compartment blower positioned within said air corridor portion of the condenser compartment in the path of air flow between said auxiliary air inlet and the exhaust fan, said second motor having a horizontal shaft passing through a portion of said divider to mount the wheel within the scroll of said blower, whereby the heat from the evaporator motor is carried by air from the auxiliary air inlet through the air corridor portion to the condenser exhaust fan without entering the evaporator compartment.

2. An air conditioner unit as defined in claim 1, there being an electrical resistance heater in the evaporator compartment, the said evaporator blower motor located in the condenser compartment air corridor portion there having a supplementary cooling fan, whereby to cool same while the resistance heater is in operation without operating the first said motor and its exhaust fan.

3. A self-contained air conditioner as defined in claim 1, the housing having in its outer side wall an access door into said air corridor portion of the condenser compartment and adjacent to said evaporator blower motor therein, that portion of the divider through which said motor shaft passes being so sized as to be removable through said access door and having said motor assembled thereto on its air corridor side and said blower wheel assembled on its evaporator compartment side, whereby, on opening said side wall access door and removing said divider portion, the blower wheel is removable axially from the scroll and access is provided through the scroll to the interior of the evaporator compartment.

4. A self-contained air conditioner comprising a generally rectangular housing having a top, a bottom, an inner edge wall, two side walls thereadjacent, and an outer side wall, the inner edge wall including a cooled air outlet from an evaporator compartment, said evaporator compartment being bounded by a portion of said housing inner edge wall and an adjacent portion of a housing side wall, being further bounded by a vertical divider so angled as to leave the remainder of said housing as an L-shaped condenser compartment comprising a larger part having a main air inlet and a condenser coil therein and having in its top wall an exhaust fan on the vertical shaft of a first motor, and a smaller part leading to said larger part and having an auxiliary air inlet, whereby to provide an air corridor to the exhaust fan, further having an access door, the portion of the divider inwardly adjacent to the access door being removable and having mounted thereon in such air corridor a second motor having a horizontal shaft extending therethrough to mount a blower wheel within said blower scroll in said evaporator compartment, whereby said removable divider portion with said second motor and blower wheel mounted thereon may be removed through the air corridor and access door to provide access to the evaporator compartment through the evaporator blower scroll.

5. A self-contained air conditioner as defined in claim 4, the evaporator compartment further having, between said blower scroll and said cooled air outlet, an electric resistance heater positioned substantially perpendicular to the divider and having terminals extending to such air corridor of the condenser compartment, the divider having means to mount said heater and permit its removal therethrough into such air corridor of said condenser compartment and out said access door.

* * * * *